United States Patent [19]

Koser et al.

[11] Patent Number: 4,565,146

[45] Date of Patent: Jan. 21, 1986

[54] BOAT HULL AND METHOD OF MAKING SAME

[75] Inventors: Jaroslav Koser, Braunau-Ranshofen; Theodor Eder, Perchtoldsdorf, both of Austria

[73] Assignee: Austria Metall AG, Vienna, Austria

[21] Appl. No.: 311,014

[22] Filed: Oct. 13, 1981

[30] Foreign Application Priority Data

Oct. 13, 1980 [AT] Austria ..... 5074/80

[51] Int. Cl.[4] ..... B63B 3/00; B63B 5/24

[52] U.S. Cl. ..... 114/79 R; 114/88; 114/356; 114/357

[58] Field of Search ..... 114/356–358, 114/82, 79 R, 79 W, 80, 88; 403/381, 248, 251, 374; 72/395

[56] References Cited

U.S. PATENT DOCUMENTS

| | | | |
|---|---|---|---|
| Re. 30,154 | 11/1979 | Jarvis | 403/381 X |
| 509,364 | 11/1893 | Coffeen, Jr. | 403/381 |
| 643,552 | 2/1900 | Squires | 403/381 |
| 1,107,477 | 8/1914 | Bartels | 403/381 |
| 1,667,561 | 4/1928 | Mediavilla | 114/356 |
| 2,322,160 | 6/1943 | Schlagel | 114/356 |
| 3,156,210 | 11/1964 | Lyon | 114/356 X |
| 3,220,027 | 11/1965 | Metzner | 114/356 |
| 3,314,270 | 4/1967 | Dolney | 72/395 X |
| 3,388,446 | 6/1968 | Phillips | 114/356 X |
| 4,077,813 | 3/1973 | Fletcher | 148/125 |

FOREIGN PATENT DOCUMENTS

| | | |
|---|---|---|
| 1053289 | 3/1959 | Fed. Rep. of Germany . |
| 1531600 | 12/1969 | Fed. Rep. of Germany . |
| 1480643 | 7/1972 | Fed. Rep. of Germany . |
| 2913609 | 10/1980 | Fed. Rep. of Germany . |
| 471836 | 10/1937 | United Kingdom . |

OTHER PUBLICATIONS

Article entitled "Self-Locking Aluminum Panels Speed Construction Work", by K. Glaser, from *The Iron Age*, Sep. 8, 1960.

*Primary Examiner*—Sherman D. Basinger

*Attorney, Agent, or Firm*—Karl F. Ross; Herbert Dubno

[57] ABSTRACT

A ship hull is formed of a plurality of transverse and generally parallel ribs and a plurality of side-by-side plank-forming and generally parallel elongated profiles each having two generally parallel londigitudinal edges abutting the edges of the adjacent profiles. One of the edges is formed with an inwardly extending flange engagng the ribs. Thus the flanges stiffen the profiles. Screw fasteners extend through the flanges and into the transverse ribs for securing the profiles to the transverse ribs. Seals form watertight joints between the abutting longitudinal edges of the profiles.

5 Claims, 14 Drawing Figures

BOAT HULL AND METHOD OF MAKING SAME

BACKGROUND OF THE INVENTION

The boat hull has been developing for thousands of years. The most important construction styles of wooden hull are clinker, caravel, and seam-frame. All these building styles necessitate a wooden skeleton of transverse ribs on which the planks are mounted and secured. They are made watertight by caulking with oakum, the pressure necessary for a watertight joint being produced by soaking the wood to swell it. In recent times special adhesives have been used.

The next stage of development was ship hulls of steel wherein the planking, formed of three-dimensional shaped steel plates, is secured by riveting to a steel skeleton. Calking and closely juxtaposed rivets make the joints watertight.

With the development of welding technology, welding is employed in modern-day construction of large boat hulls.

For small boats principally used for sporting purposes, shaped plywood is fitted to a positive form which corresponds to the shape of the hull. Subsequently longitudinal and transverse ribs are used as stiffeners and in the latest developments a sandwich is formed with two plywood forms and a foam body between them.

The use of synthetic resins has changed the building styles in the last 15 years and made possible mass production and considerable cost reductions.

According to this method a negative form, for limited production of wood and for more extensive production of metal, is manually laminated with glass matting saturated with polyester. This method allows the hull thickness to be matched to the load and allows the use of two-skin sandwich construction.

Most recently yachts are proliferating whose hulls are made of aluminum. In these up to now the method of steel production with welding to join shaped plates is chosen.

It has also been suggested to join extruded tongue-and-groove aluminum profiles by snapping them together with a sealant mass injected into the groove and riveting them to the ribs. This construction method is principally useful for small profiles and boats, since the profiles in the prebent condition cannot be fitted and joined together readily, so that a later bending to the ribs is necessary, which bending is only possible with small profiles without reinforced flanges as longitudinal ribs.

OBJECTS OF THE INVENTION

The instant invention aims at carrying the advantages of the first-given woodbuilding method into modern materials. Today's production levels, in particular with sporting craft with a length of over 10 m, are only rarely great enough for amortization of the expensive negative hull form. The hulls are relatively expensive and changes, for example to improve the hydrodynamics based on the prototypes, can only be carried out by building a new expensive form.

SUMMARY OF THE INVENTION

This is achieved according to the invention in that the parts determining the boat shape are constituted as metal or synthetic-resin profiles that extend parallel to one another longitudinally of the boat engaging one another edge-wise and fulfilling the function of the watertight outer skin as also of the bend-resistant longitudinal boat ribs.

With the suggested construction style a skeleton is not necessary. Only a frame of transverse ribs is used, with the planking mounted on it. The individual profiles that form the planking, according to another characteristic of the invention, are prebent (arced) to the desired hull shape beginning at the gunwales and working toward the keel and are secured individually to the ribs. The profiles are bent such that they form ribs and have great bending resistance with small thickness and thereby contribute substantially to weight reduction. The profiles further allow that by certain means, such as grooving, it is possible to form watertight joints easily.

The advantage of this construction method is that, in addition to a reduction in weight with increased rigidity, the shell is simply formed by arcing to a desired hull shape, without having to use expensive devices for this function.

DESCRIPTION OF THE DRAWING

The above and other features and advantages will become more readily apparaent from the following, reference being made to the accompanying drawing which.

SPECIFIC DESCRIPTION

Figure 2:
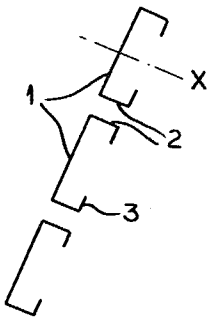
FIG. 2 is an end view of the profilesof FIG. 1.

As can be seen from the drawing, the boat hull is formed of an array of adjacent profiles which form a three-dimensionally bent boat outer skin bent along two axes and then fitted together, with the connection being made by screw connection after fitting in the seal so that at any time individual profiles can be separated from one another and replaced for repair. The bending takes place not only about the longitudinal axis but also about the short x-axis, which bending is referred to as arcing. In order to join them and to increase their rigidity the profiles 1 are of U-, L-, or C-section with straight or slightly curved web and with flanges 2 which serve for screw connection or riveting to the adjacent profiles while the bent-down ends 3 of the flanges 2 serve for joining with the also U-section profiled ribs 17 (FIGS. 5 and 8) by means of screws 20. The boat hull is advantageously made up in two halves which then are connected with the keel 18 and the transom 19, which can also be formed as profiles. This connection can be made by welding, gluing, screwing, or riveting. The profiles 1 are preferably made of an extruded aluminum profile of a saltwater-resistant aluminum-magnesium alloy, but can also be made as extruded glass-fiber reinforced synthetic-resin profiles. The shaping of the profiles 1 can, as visible from FIGS. 3–7, be different as can the type of joint.

Figure 3:
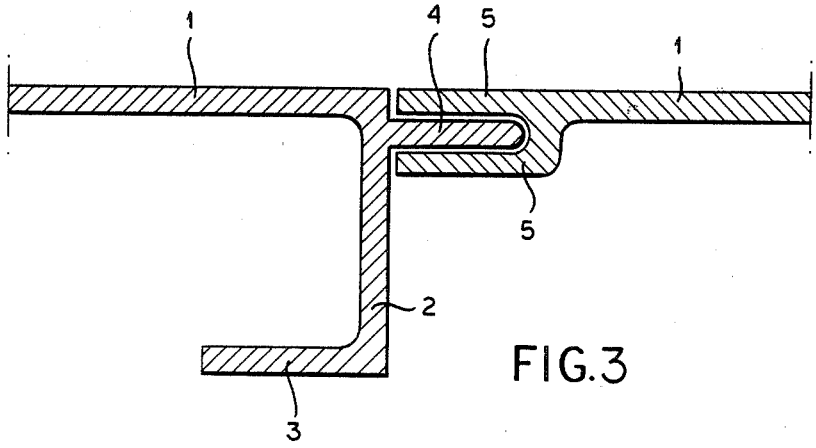
FIG. 3 is a large-scale cross section through two profiles according to the invention at the joint between them.
Figure 4:
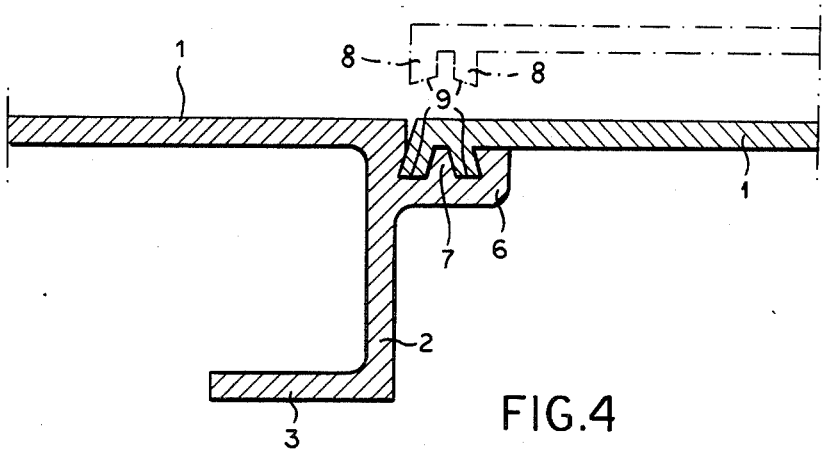
FIGS. 4, 5, and 6 are views like FIG. 3 illustrating further joints according to this invention.

FIG. 3 shows an embodiment wherein the profile has on only one side a flange 2 with a bent-over flange end 3 whereas the other side has a fork-shaped end 5 in which the rib 4 of the adjacent profile end is slipped so that a tongue-and-groove joint is formed. With the arrangement of FIG. 4 one rib 6 forms an inwardly widening or undercut dovetail groove 7 in which the fork-shaped end 8 of the adjacent profile is fitted. The fork-shaped end 8 has oblique surfaces 9 which are driven or pressed into the groove 7 so that the fork ends spread and a unitary and watertight joint is produced.

Figure 5:
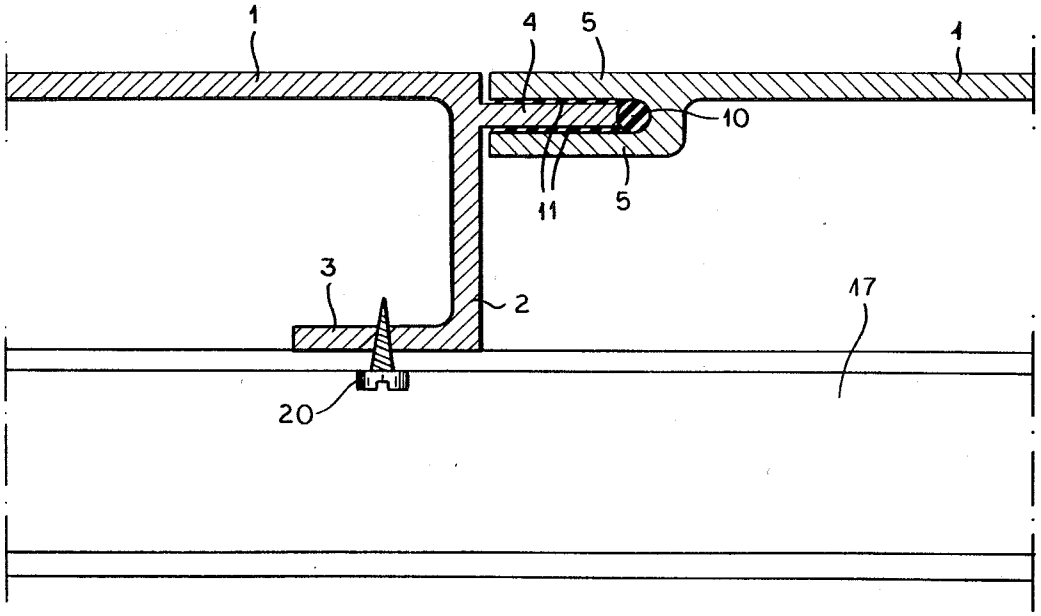
Figure 6:
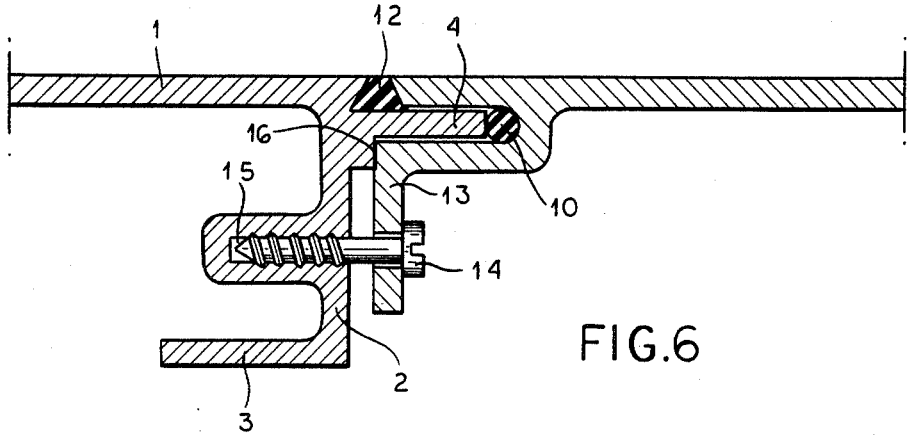
Figure 6A:
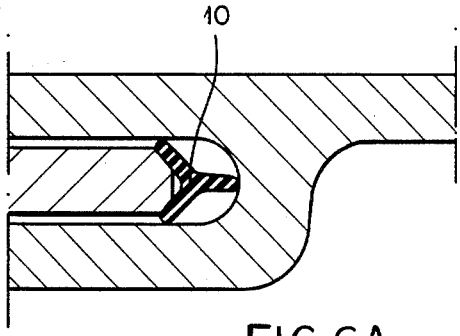
FIG. 6A is a large-scale view of a detail of a variant of the joint of FIG. 6.
Figure 7:
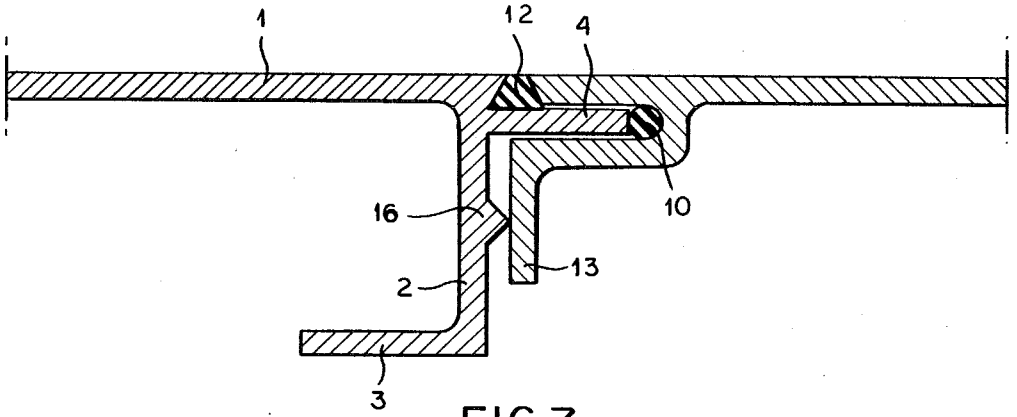
FIG. 7 is another view like FIG. 3 illustating yet another joint according to the present invention.

If metallic joints cannot be used it is possible according to FIG. 5 to leave so much room between the forked flanges 5 which receive the rib 4 that an elastic seal 10 and a glue layer 11 can be fitted in which if of long-lived elasticity also allow sliding caused by working of the hull without leakage. The joint can also be formed as a double joint as shown in FIG. 6 which in addition to the seal cord 10 has an externally visible elastic seal 12 which sits in an outwardly open but inwardly widening dovetail groove. In order to join the two profiles, the abutting profile ends have flanges with in the flange 2 of the one profile a screw groove for receiving connecting screws 14 which pass through the flange 13 of the adjacent profile. The screw 14 can be a self-tapping screw and the groove 15 can be formed in its sides with ridges or ribs to mesh with the screwthread. According to FIG. 7 the flanges 2 of the one profile have a sharp abutment rib 16 for the flange 13 of the adjacent profile.

The invention is not limited to the illustrated embodiments. The rib 4 can on its outside be formed with ridges for better anchoring of the elastic caulk or adhesive. All known seals of rubber or synthetic-resin base can be used as the material for the seal cords and caulk, and even silicon is not excluded.

Figure 1:
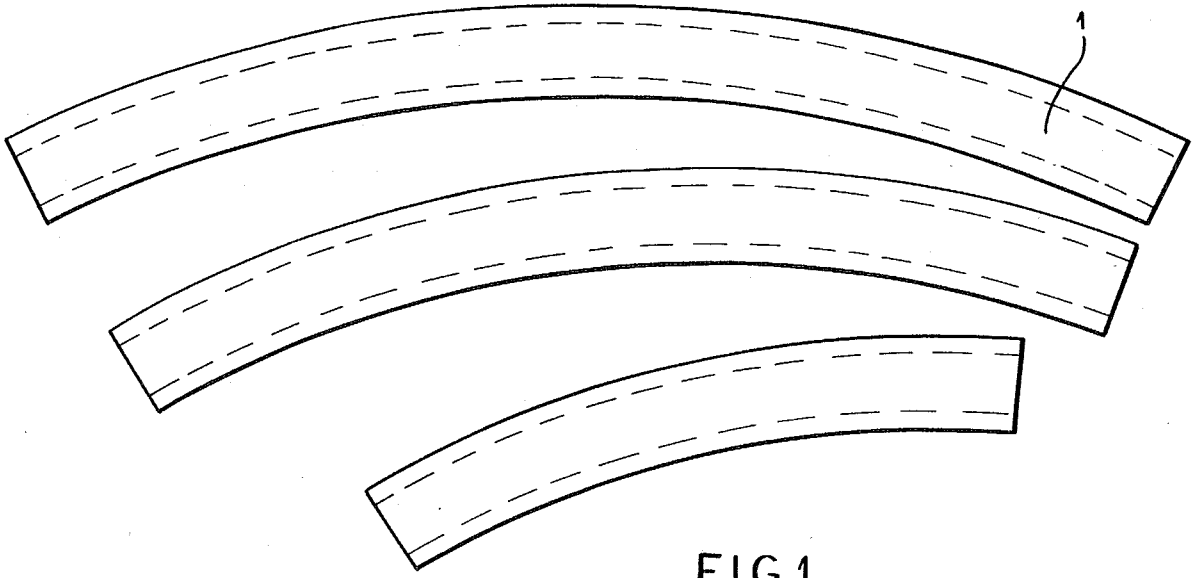
FIG. 1 is a side view of profiles according to the invention.
Figure 8:
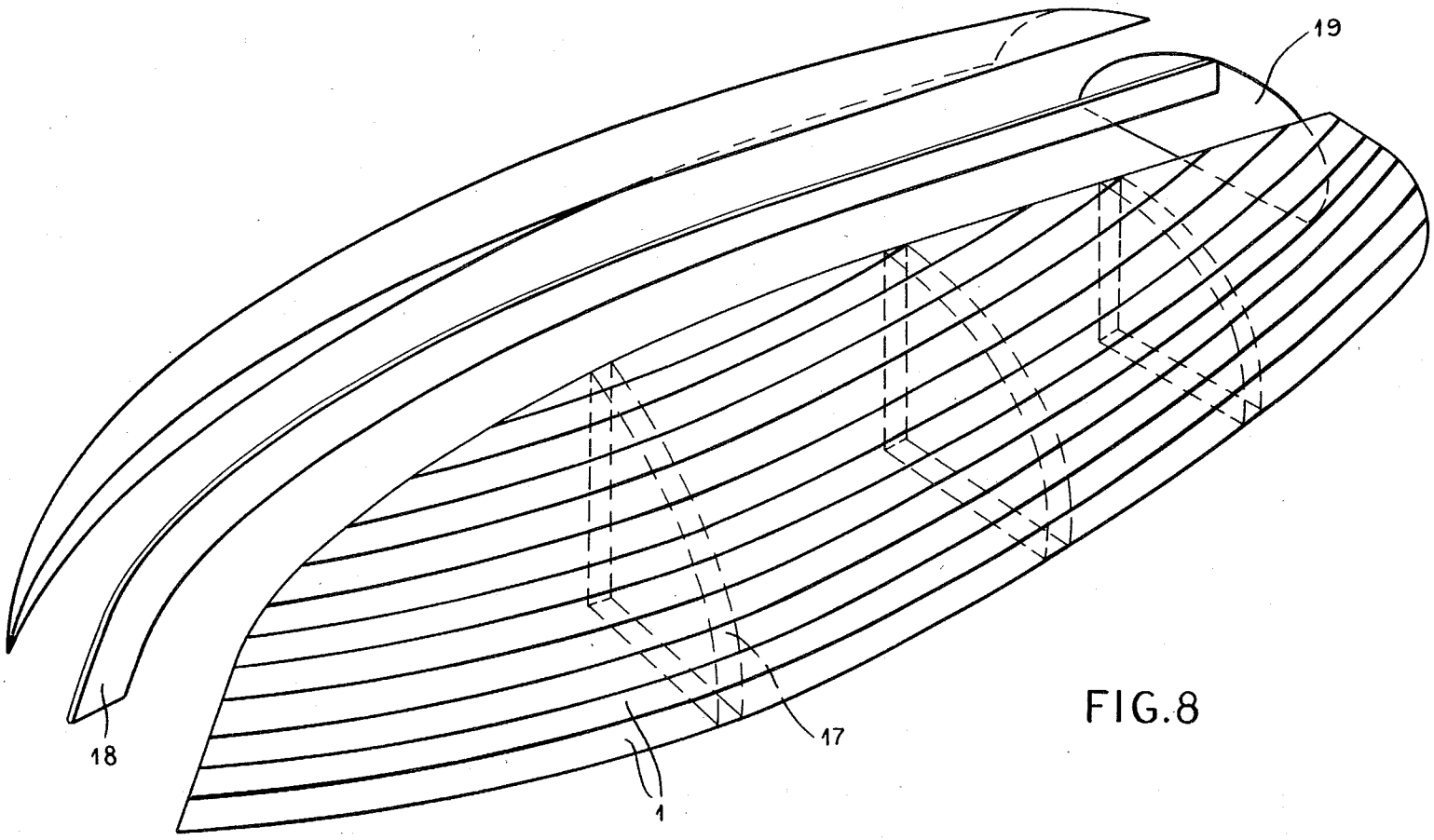
FIG. 8 is a partly exploded view of a boat hull according to the invention.

The arcing is better explained with reference to FIGS. 8, 1, and 2.

Figure 9:
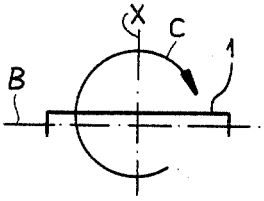
FIG. 9 is a diagrammatic end view illustrating the arcing of the profiles in accordance with this invention.

One can see that the individual profiles, which are bent to correspond to the boat shape, are bent in several ways. According to FIG. 9 they are bent mainly about the axis B and each profile is twisted over its entire length as indicated by torsion C.

All profiles must in addition be bent about the important axis x. This is done since the boat hull at different locations on its section must be differently bellied. As a result the planking with the profiles must bridge long regions along the ribs. If the profiles have the same width over their entire length, as in the preceding case, the described bending—referred to here as arcing—about the axis x is necessary, as mentioned above. The individually prebent profiles then appear as in FIG. 1 with the profiles seen in top view in FIG. 2.

The profiles according to the invention are relatively easy to bend about the axis B and also relatively easy to twist as shown at C so that no prebending is necessary for these bends. These bends are made on mounting of the individual profiles on the ribs 17 and during screw connection of the individual profiles together. A bending of the profiles about the axis x, the arcing, is however not possible. The arcing takes place according to the instant invention in a separate step. Thus the arcing curve for each profile in separately drawn profile views can be ascertained or can for example be derived by an appropriate computer program from the construction drawings of the yacht. Correspondingly arced profiles form, when joined to the ribs 17, the boat hull with the edges of the profiles butting each other and without having to force the profiles against one another.

Figure 10:
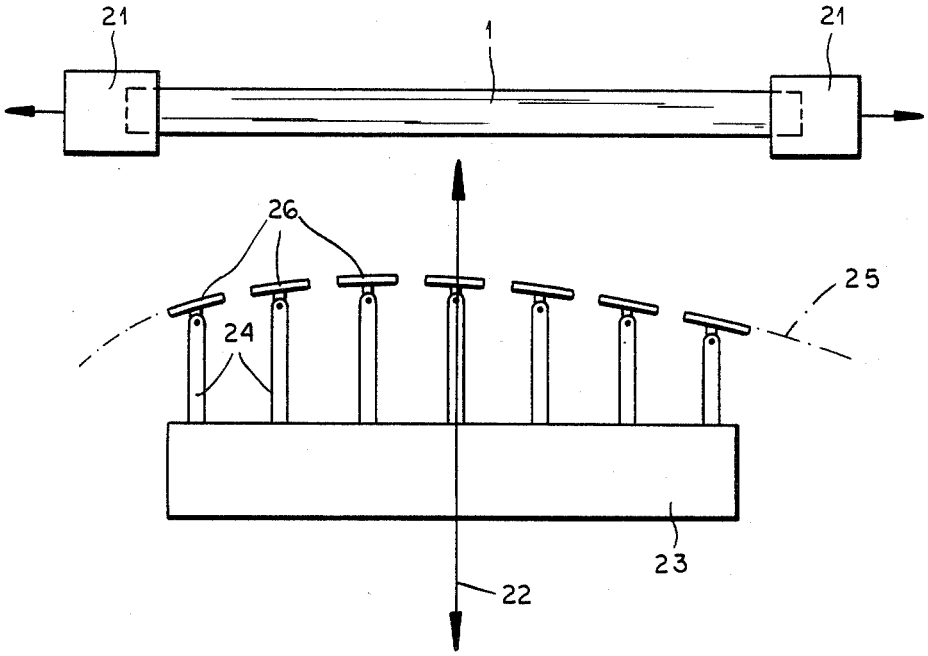
FIG. 10 is a top view of an apparatus for arcing the profiles.

The prebending of the profiles about the x-axis has shown itself to be extremely difficult in practice. The stiffness of the profile along their width results with standard bending in malformations so that the desired boat shape cannot be obtained. Preferably a vehicle is used along whose entire length a ram of the profile to be bent is carried so that this shape can correspondingly be made. When this vehicle is driven against the profile the ram bends the profile into the necessary shape. FIG. 10 shows such an apparatus purely schematically. The profile 1 is at both ends clamped in a pulling device 21 and is stretched almost to the deformation point. The vehicle 23 movable in the direction of the arrow 22 carries the ram 24 which is so set up that its front points lie on a line 25 which corresponds to the desired bent shape or arc for the profile 1. The ram 24 carries on its front end leaf springs 26 to insure that the pressure on the profile 1 is not exerted at points but on a surface. If the vehicle 23 with the ram is driven during the prodecure against the profile 1, this profile 1 is bent to conform to the line 25 without an undesirable crumpling of the profile and without it changing shape again after the bending operation.

Figure 11:
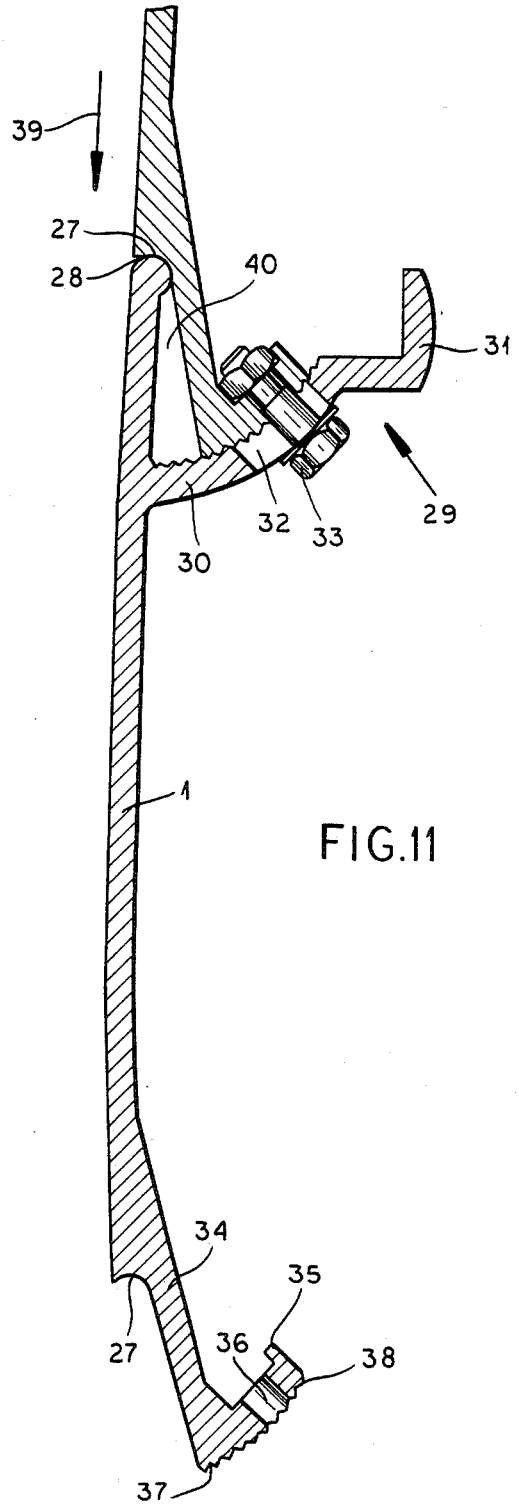
FIG. 11 is a cross section through another profile according to this invention.

In addition FIG. 11 shows a particularly advantageous embodiment of the profile section. The lower profile shown in this figure is wholly shown, whereas the upper profile is broken away. The profile 1 has along its entire length a groove 27 in which the head 28 of the adjacent profile engages. In the vicinity of this head 28 is a web 29 which is formed of a first arcuate portion 30 and a second angular portion 31. The arcuate portion 30 has a radius R with a center that lies in the head 28. At a predetermined spacing from one another there are slots 32 which serve for screw connection with the next adjacent profile by means of screws 33. Each profile has on the side of the groove 27 an L-shaped strut whose bent-in lower flange 35 is formed with a longituinal slot 36 that extends longitudinally of the profile 1. At each location where the slots 32 and 36 cross a screw connection by means of a screw 33 is possible. The lower surface 37 of the flange 36 also has the radius R and presses against the arcuate portion 30 of the flange 29. Since when put together the boat shape can change corresponding to the angle between two profiles, the contact surface 37 must make these changes possible. The arcuate portion 30 is provided with a roughening formed as fine longitudinally extending ridges in which a pusher edge 38 and/or a coarser toothing can be deformed plastically by the screw connection 33. In this manner once screwed together the parts cannot turn relative to each other.

The bent-over flange 31 serves for securing the profiles with the ribs of the boat and forms the necessary longitudinal rib needed for rigidity in a boat hull.

Flange 31 and rib 27 can have cylindrically bowed surfaces which by correspondingly shaped intermediate profiles permit a three-dimensional fitting on any three-dimensional angular position.

The profile shown in FIG. 11 has the advantage that for a predetermined angular range the profiles can be fitted to the various rib arcs. The engagement in the groove 27 is also possible for arced, that is bent, engagement lines at assembly. The parts 29–31 forming the longitudinal rib are on arcing in the pressure zone of the ram 24 or guides 25. The opposite part 34-37 in the free tension zone is substantially smaller, so that deformations in the cross-section plane are avoided.

The space provided between adjacent profiles 40 for receiving a sealant mass which is carried in the groove 27 starts directly on the water-engaging outer surface and thereby eliminates the danger of groove corrosion. The possibility of screw connection together gives the boat the necessary rigidity.

Figure 12:
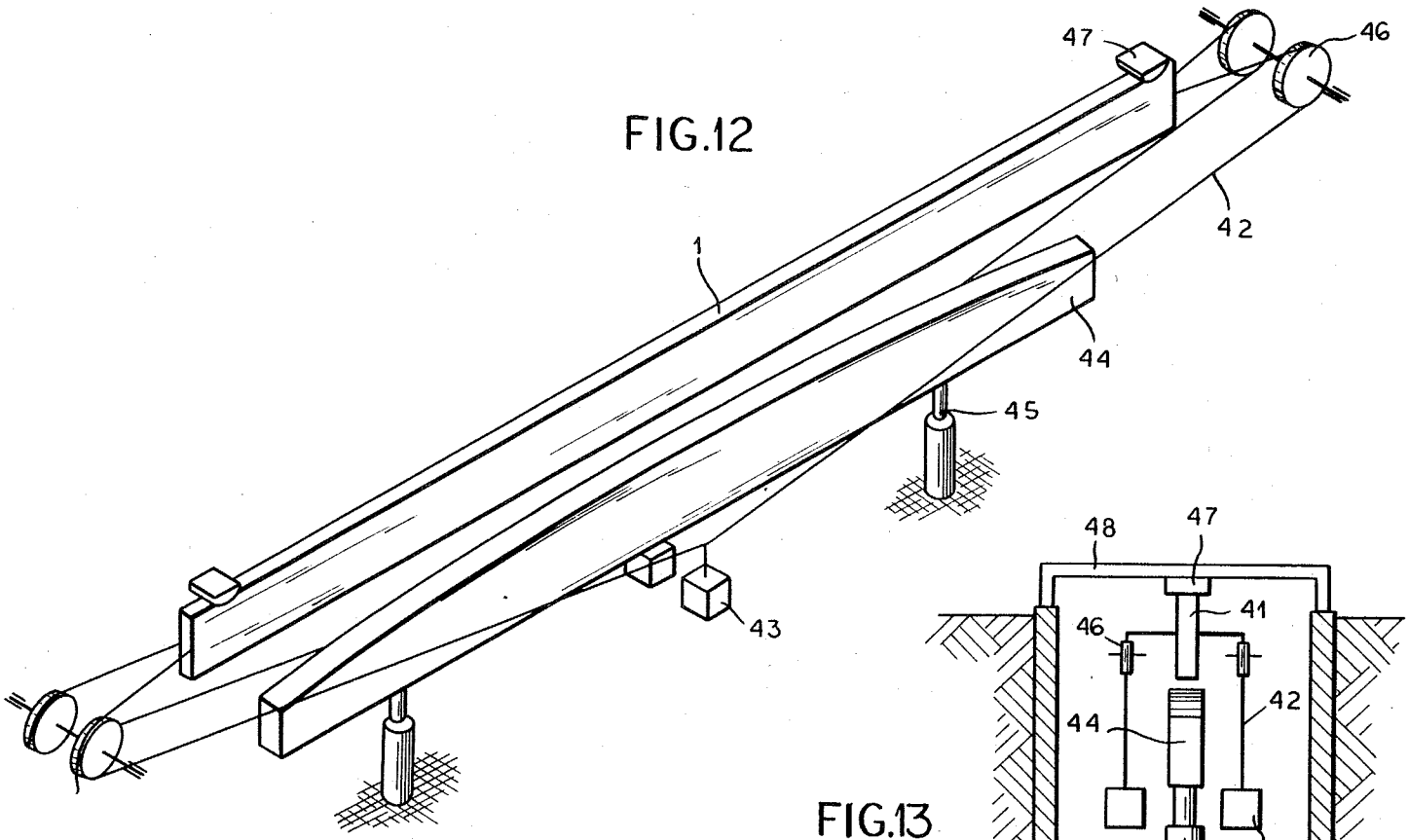
FIG. 12 is a perspective view of another apparatus for arking the profiles.
Figure 13:
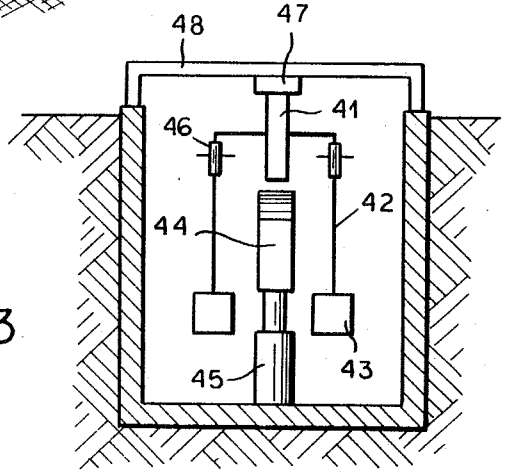
FIG. 13 is a vertical section through the apparatus of FIG. 12.

The particularly simple apparatus for arcing the profiles 1 shown in FIGS. 12 and 13 is arranged in a pit and comprises a bending template 44 which is pressed by hydraulic cylinders 45 or spindle drives against the profile 1 with the profile 1 being tensioned by a cable stretching device 42 with deflecting rollers 46 and weights 43 with some 20 tons. The profile is meanwhile supported by movable supports 47 against a yoke 48.

We claim:

1. A ship hull comprising:

a plurality of transverse and generally parallel ribs;

a plurality of side-by-side plank-forming and generally parallel elongated profiles each having two generally parallel longitudinal edges abutting the edges of the adjacent profiles of nonplanar three-dimensional shape, one of the edges being formed with an inwardly extending flange engaging the ribs, whereby the flanges stiffen the profiles, one of each of the longitudinal edges of each profile being formed with an outwardly rounded seat and the other of each of the longitudinal edges of each profile being formed with a complementary rounded edge, the flange extending inwardly from adjacent the rounded edge and having a curved portion having a center of curvature at the respective rounded edge, each of the other edges having an attachment flange enageable with the curved portion;

means including fasteners extending through the flanges and into the transverse ribs for securing the profiles to the transverse ribs; and means forming watertight joints between the abutting longitudinal edge of the profiles; and means including screw fasteners engaged between the abutting longitudinal edges for securing same together and compressing the respective joints, the screw fasteners being bolts engageable between the attachment flanges and the curved portions for securing the profiles together at any of a multiplicity of relative positions angularly offset about the center.

2. The hull defined in claim 1 wherein the curved portion and the attachment flange have mutually engaging roughened surfaces.

3. The hull defined in claim 1 wherein the curved portion and the attachment flange are formed with crossing elongated slots through which the bolts engage.

4. A ship hull comprising:

a plurality of transverse and generally parallel ribs;

a plurality of side-by-side plank-forming an generally parallel elongated profiles each having two generally parallel longitudinal edges abutting the edges of the adjacent profiles, one of the edges of each profile being formed with an inwardly extending flange engaging the ribs, whereby the flanges stiffen the profiles, one of each of the longitudinal edges of each profile being formed with an outwardly open rounded seat and the other of each of the longitudinal edges of each profile being formed with a complementary rounded edge, the flange extending inwardly from adjacent the rounded edge and having a curved portion having a center of curvature at the respective rounded edge, each of the other edges having an attachment flange engageable with the curved portion, the curved portion and the attachment flange being formed with respective crossing elongated slots;

means including bolts engaging through the slots of the attachment flanges and the curved portions for securing the profiles together at any of a multiplicity of relative positions angularly offset about the center;

means including fasteners extending through the flanges and into the transverse ribs for securing the profiles to the transverse ribs; and means forming watertight joints between the abutting longitudinal edges of the profiles.

5. A ship hull comprising:

a plurality of transverse and generally parallel ribs;

a plurality of side-by-side plank-forming and generally parallel elongated profiles each having two generally parallel longitudinal edges abutting longitudinal edges of adjacent profiles, one of the edges of each profile being formed with a respective inwardly extending transverse flange and a further flange at substantially a right angle to said transverse flange and adapted to bear against said ribs, an abutting edges of an adjacent profile being formed with an inwardly extending transverse flange substantially parallel to the first mentioned transverse flange, said flanges stiffening said profiles;

means including fasteners extending through said further flange and into said transverse ribs for securing said profiles to the transverse ribs;

an elongated-cross-section, parallel-walled groove formed in each of said profiles along a respective longitudinal edge thereof turned toward an abutting edge of an adjoining one of said profiles and a longitudinally extending elongated-cross-section plate-shaped tongue projecting from the abutting edge of the adjoining profile and extending into the respective groove;

a compressible seal seated in said groove, a respective tongue bearing against said seal and compressing same whereby said seals, said tongue and said grooves form water tight joints between said profiles; and means including screw fasteners bridging the transverse flanges at each pair of abutting edges for compressing the respective seals at the respective joints.

* * * * *